United States Patent [19]

Crisci

[11] 4,004,710

[45] Jan. 25, 1977

[54] CONTAINER AND CLOSURE THEREFOR

[75] Inventor: Victor Eugene Crisci, Wellsburg, W. Va.

[73] Assignee: Mammoth Plastics, Inc., Wellsburg, W. Va.

[22] Filed: Dec. 31, 1975

[21] Appl. No.: 645,891

[52] U.S. Cl. ..... 220/306; 220/355; 220/356

[51] Int. Cl.[2] ..... B65D 41/16; B65D 43/06; B65D 43/08

[58] Field of Search ..... 220/306, 355, 356

[56] References Cited

UNITED STATES PATENTS

| | | | |
|---|---|---|---|
| 3,137,409 | 6/1964 | Davis | 220/306 X |
| 3,339,792 | 9/1967 | Biglin | 220/306 |
| 3,372,834 | 3/1968 | Ayotte et al. | 220/306 |
| 3,474,928 | 10/1969 | Hurtt | 220/306 |
| 3,804,289 | 4/1974 | Churan | 220/306 |
| 3,811,597 | 5/1974 | Frankenberg et al. | 220/306 X |

*Primary Examiner*—William Price
*Assistant Examiner*—Steven M. Pollard
*Attorney, Agent, or Firm*—Stevens, Davis, Miller & Mosher

[57] ABSTRACT

A snap-lid container, particularly in plastics material, of the pail type for fluid materials. A fluid-tight seal between the container and lid is effected by peripheral contact under pressure between a convex inner edge of the container lip and a splayed surface within a peripheral, inverted U-groove in the lid. Sealing pressure is provided by coaction between complementary sloping surfaces on the container lip and within the lid peripheral groove respectively which tends to draw the lid in a closing direction.

2 Claims, 3 Drawing Figures

CONTAINER AND CLOSURE THEREFOR

This invention relates to containers and closures therefor and more particularly to containers manufactured of plastics materials and adapted to hold fluids such as latex-based paints and the like.

Paint, a material which requires a strong light-weight container, traditionally is packaged in cylindrical drum-type cans fabricated from sheet metal - usually tin-plated steel. Due to the nature of paint, it is necessary to have a completely fluid-tight seal between container and lid otherwise drying out of the material would occur thereby rendering it useless. A simple circular lid having a formed peripheral edge such as to provide an interference fit within the mouth of the container provides an adequate seal.

Convenience and cost consideration in the manufacture of containers result in a structure which includes joined seams. These seams are points of weakness where corrosion may begin. With oil based paints, this is not normally a problem but with latex base paints which include a considerable amount of water in their makeup, it can be. To overcome this, the seams must be specially treated to inhibit corrosion thereby adding to the cost of the container.

Metal paint container bodies, again for reasons of ease of production and cost, are usually cylindrical in shape so that when empty they cannot be "nested". Packaging of empty containers, therefore, is bulky and inconvenient from a handling, storing, transportation and expense point of view.

To overcome the disadvantages of metal containers, paint containers made from plastics materials have been made. In these constructions, in order to obtain the fluid-tight seal between the container and closure, an O-ring or other type of resilient seal has had to be used. Plastics containers of known design rely upon such a large constrictive force in the closure to retain them closed that the closures need to be slit to enable them to be removed or their removal is only possible by use of removal tools which render them permanently damaged.

An object of the present invention is to provide a closure of plastics material for a container body which may be removed without damaging the closure thereby enabling it to be re-used.

Another object is to provide a container of plastics material which avoids the need for the use of a seal which is additional to the container body and closure.

According to one aspect of the present invention, there is provided a plastics closure for a container body, the closure having a cover portion surrounded by an annular U-shaped rim, the rim comprising a radially inner axial wall, a spaced radially outer axial wall and a base interconnecting said walls which define between them an axially facing recess for receiving a lip of the body, the outer wall incorporating a radially inwardly projecting bead spaced from the base and a skirt which flares outwardly from the outer wall on the side of the bead remote from the base, and the outer wall being resiliently flexible outwardly to enable snap engagement of the closure with and its release from the container lip.

In the above closure according to the invention, the bead is a relatively stiff portion of the outer wall which applies an annular constricting force to hold the wall in its normal position. The flared skirt acts as a lever which when urged radially outwards and upwards at a specific circumferential point, flexes the outer wall at that point resiliently to stretch the bead to allow it to commence movement around the lip in a closure releasing direction. Outward levering of the skirt circumferentially in a progressive manner from said specific point stretches the bead in corresponding fashion so as completely to unseat it from the lip. The bead serves not only as a constrictive force but because it is a region of relatively greater stiffness than the remainder of the wall, the wall tends to flex at a bend position towards the base upon the application of a radially outwards force upon the skirt so that the bead is pivoted from the bend position.

In addition, the flared skirt tends towards an axially straight line relationship with the remainder of the outer wall whereby when a radially outwards force is applied to the skirt, there is a large component of force also applied radially outwards to the remainder of the wall so as to stretch it. With this construction, the skirt may have a thickness no greater than the remainder of the wall, apart from at the bead, while being sufficiently stiff to cause bead removal without any undue flexing of the skirt itself relative to the wall towards the base. In preferred constructions, the angle of the skirt is between 35° and 45° to the axial direction in its normal and unflexed state with the preferred angle being 40°.

According to another aspect of the present invention, a container comprises a container body and a closure both being of plastics material, the body having an annular wall defining an opening and a lip around the opening, the lip having a sealing region surrounding the opening and a radially outwardly directed shoulder spaced axially along the wall from the sealing region, and the closure having a cover portion surrounded by a U-shaped rim, the rim comprising a radially inner axial wall, a spaced radially outer axial wall and a base interconnecting said walls which define between them an axially facing recess of the rim for insertion of the lip between the walls, the rim also including a sealing region in an area of the inner wall and base, one sealing region being in compressively loaded and tangential engagement with the other region along a single annular line when the lip is received within the rim, and the outer wall incorporating a radially inwardly projecting bead to coact with the shoulder to urge the sealing regions into said engagement, the outer wall being resiliently flexible outwardly for snap engagement around and release from the shoulder.

The container body and closure provide a cheap, easily manufactured, container which, when the two parts are assembled together is fluid tight and the closure will not easily detach itself from the container body under loads applied to it in an accidental manner because of the circumferentially applied constrictive force by the bead. The sealing regions provide an efficient seal as the full compressive loading acting between the sealing regions acts at the single annular line of contact thus creating maximum pressure conditions to make and retain a sealed condition.

The two sealing regions may be surfaces which are of such relative shapes as to provide single annular line of contact when they are engaged. In one preferred arrangement, the rim sealing region is an annular splayed surface extending radially outwards towards the base and the lip sealing region is a convex edge of the lip. Alternatively, however, other shapes may be used to produce a comparable sealing effect. For instance, a convex surface may be provided for the rim sealing region while a chamfered edge of the lip is the lip sealing region; in other constructions both sealing regions may be surface or edge shapes which are convex, or a convex shape may be required to fit into a concave shape of greater radius so that single line contact is achieved. In addition, dependent upon design considerations, the sealing region of the closure may be located at a junction point of the inner wall and base, or upon the inner wall or base. In the latter cases, a step in the wall or base forms a shoulder for engagement by the lip.

An understanding of the invention will be gained from reading the following description taken in conjunction with the accompanying drawings illustrating one embodiment and wherein.

Figure 1:
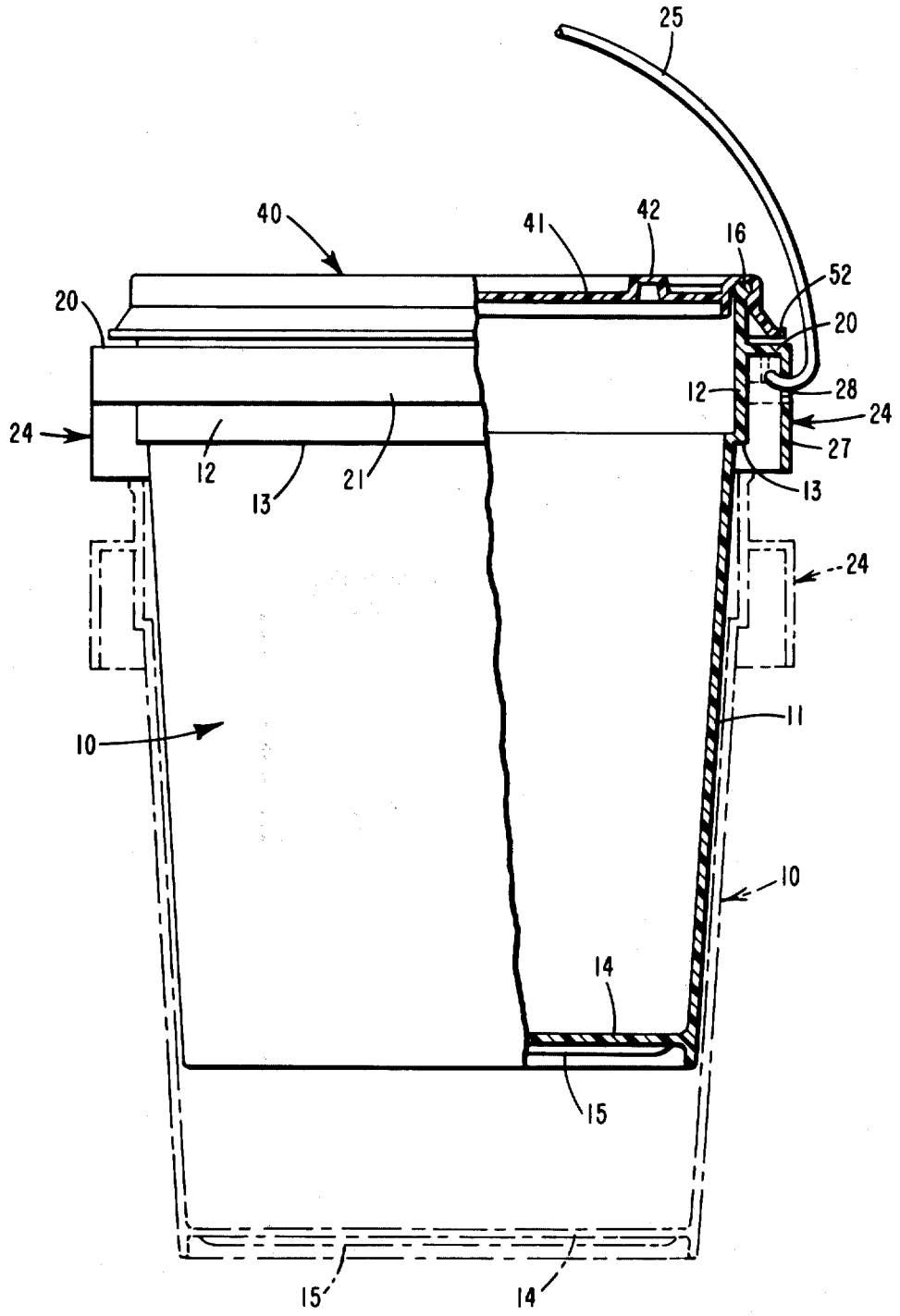
FIG. 1, is a side elevational view of a paint container showing the body and closure assembled and partly in section, and nested in another container shown in phantom lines.

A container comprises a container body generally indicated at 10 in FIG. 1, which is a one-piece moulding in plastics material such as high density polyethylene. An annular side wall 11 tapers gently at an angle of 2° to the container axis of symmetry from a narrow upper end portion 12 defined by a step 13 to a recessed bottom wall 14 reinforced by an integral radial rib structure shown in part at 15.

Figure 2:
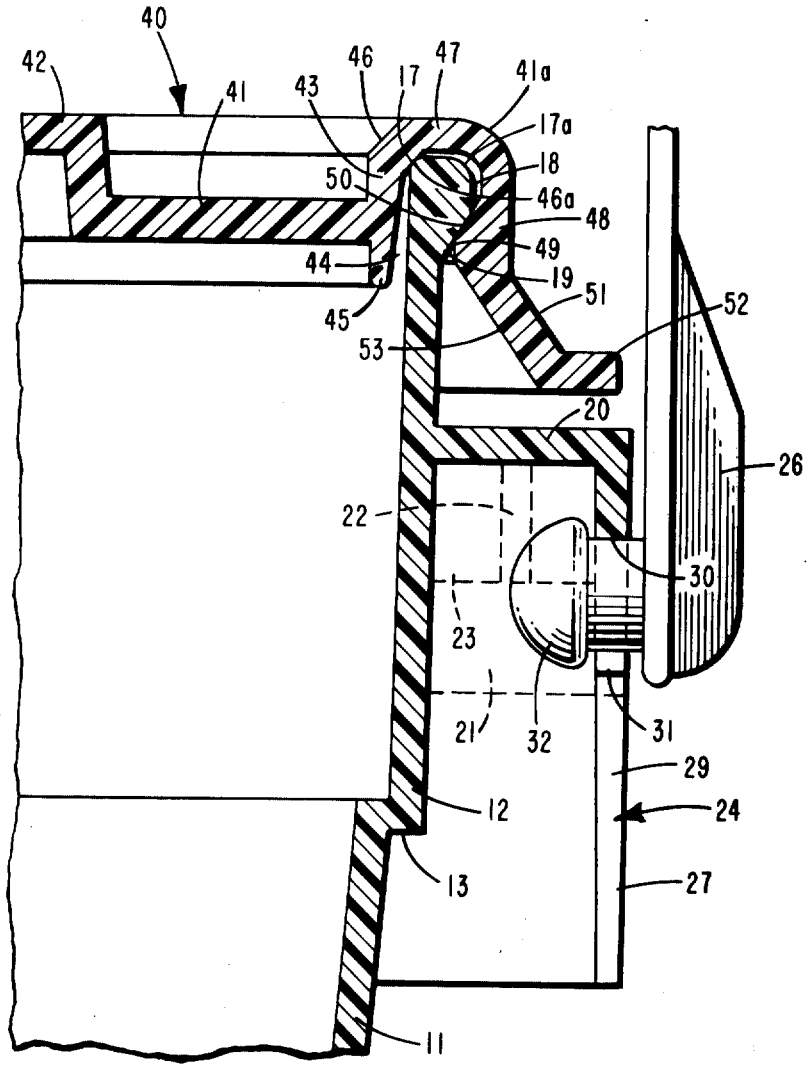
FIG. 2, is a cross-sectional view, on a larger scale than FIG. 1, of portions of the assembled container and closure rim showing the seal and also showing a modification to a bail anchoring means shown in FIG. 1.

Turning now to FIG. 2. Upper end portion of side wall 11 is generally cylindrical and terminates in a lip 16 defining a circular container opening. Generally rectangular in cross-section, the lip of the container has a sealing region comprising a convexly radiused edge 17 at and surrounding the opening and an outer radiused edge **17*a*. The lip 16 is thicker than side wall portion 12 immediately below it whereby there is provided a radially outwardly directed shoulder 18 having a lower surface 19** which slopes inwards and downwards to the container side wall at a preferred angle of 38° to the vertical but which may be at any angle between 35° and 45°.

A short distance below rim 16, there extends a radial flange 20 carrying at its outer peripheral edge a dependent skirt 21 generally parallel to and spaced from upper portion 12. At the upper end of the annular recess formed by the flange 20, the skirt 21 (FIG. 1) and the upper portion 12 there is integrally formed an intermediate annular rib 22 and a series of equi-angularly disposed radial ribs such as 23. The foregoing structure imparts a high degree of rigidity to the upper portion 12 of the container side wall particularly to the portion including rim 16 and resists any tendency for the container body to flex at the lip under the weight of contained paint when a closure has been removed and the lip is held at one position.

Figure 3:
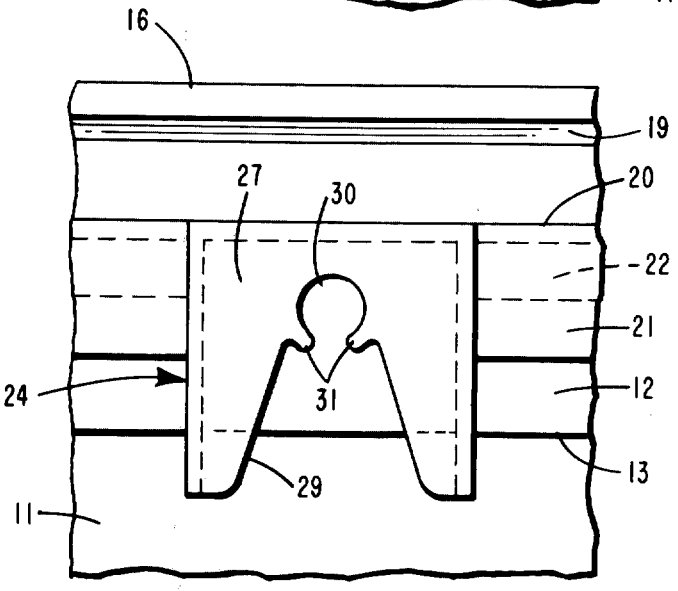
FIG. 3, is a side elevational view, on a smaller scale than FIG. 2, of a portion of the container rim showing bail anchoring means.

Two diametrically opposed bail anchoring means are integrally formed with the flange 20 and skirt 21. One bail anchoring means only is shown in FIGS. 2 and 3 at 24. The bail anchoring means may be adapted to receive a rigid common wire bail 25 as shown in part in FIG. 1 or a more flexible type 26 in preformed plastics materials shown in part in FIG. 2.

Each bail anchoring means 24 comprises a rectangular, open-bottomed, box-like structure. These structures may extend at least to the step 13 in the container side wall or further below as in the embodiment wherein it prevents the jamming together of nested containers. Outer walls 27 of the anchoring means 24 may be provided with a simple hole 28 (FIG. 1) to receive bent ends of a rigid, common wire bail 25. An alternative arrangement in the outer walls 27 includes a V-form slot 29 (FIG. 3) leading into an open sided hole 30, the hole being provided with opposing spurs 31. Mushroom-headed pins such as 32 moulded to plastics, strap-type bail 26 (FIG. 2) may be snapped into the holes 30 past the spurs 31.

A closure for container body 10 generally indicated at 40 may be moulded from the same or similar material to the container. It has been found that a high-impact polypropylene closure provides the best combination with a polyethylene container. Closure 40 comprises a horizontal cover portion 41 which includes a raised annular portion 42 which acts as a spigot with the recessed bottom wall 14 of another container in stacking filled containers one upon the other. From the peripheral edge of horizontal cover 41 there extends upwardly a U-shaped rim **41*a* defining an inverted annular recess 44. A substantially vertical axially inner wall 43 of recess 44 is splayed radially outwardly a few degrees and continued some distance below the horizontal cover 41 at 45. The inner wall 43 is joined to an axially outer wall 48 by a base of the U-shaped rim 41*a*. The base comprises a wall 46 splayed at an angle of the order of 45° which provides a sealing region of the rim having a seating surface 46*a* for cooperation with the container lip and forms a junction between inner wall 43 and an upper wall 47 of the base extending outwardly thereof. Outer wall 48 extends downwardly from the extremity of the upper wall in spaced relationship and substantially parallel to inner wall 43** and is resiliently flexible outwardly from the base.

From an inner surface of outer wall 48, there extends an annular bead 49 having an upper surface 50 which slopes downwardly inwards to the crest of the bead at an angle to the vertical which is slightly greater in the normal unflexed state of the outer wall than the angle of lower surface 19 of the container lip.

The outer wall also comprises an annular flared skirt 51 which extends radially outwards from the bead on the other side of the bead from the base at an angle of approximately 40° to the vertical. The skirt and a planar annular foot 52 with which it is provided is of a thickness which is substantially no greater than that of the remainder of the outer wall above the bead.

As may be seen, the above closure lends itself readily to being made by injection moulding techniques with a two part mould in which a male mould part forms the underside surface of the closure and skirt and the upper surface is formed by a female mould part. Removal of the male mould part is effected after removal of the female mould part. Removal of the male mould part is carried out by flexing of the outer wall of the closure thus allowing for the mould part lying within the U-shaped rim to be withdrawn.

In applying the closure 40 to the container 10, the closure is offered up to the container opening. Inner wall extension 45 is entered into the opening until a lower surface 53 of the skirt 51 sits on the outer radiused edge 17*a* of the container lip 16. Snap closure by hand is effected by commencing pressing the closure down at one spot with the lower palm of one hand which urges the skirt outwards at this point by virtue of its engagement with the edge 17*a*. Local outward flexing of outer wall 48 caused by movement of the skirt quite easily permits the crest of the bead to ride over the lip 16 so that upper surface 50 of the bead 49 now contacts shoulder lower surface 19 of the container lip and splayed surface 46*a* within the annular recess 44 contacts the inner radiused edge 17 of the container rim. The remainder of the operation is merely one of progressive pressure around the edge of the closure with the palms of both hands in opposite directions. The pressure required to force the container rim into the closure groove increases progressively until at a position opposite the starting point the closure snaps into place. During this operation, flexure of the outer wall of the closure has increased to a maximum at snap-down point while distortion of the container rim has been minimal.

In the snap-down position, peripheral contact between rim radius 17 and splayed seating surface 46*a* is made in a substantially tangential fashion; substantial portions of shoulder lower surface 19 and bead upper surface 50 are in full contact. No other parts of rim 16 contact any other parts of recess 44. In its final position, outer wall 48 of the closure is in an outwardly resiliently flexed state. Because of its resilient nature, which includes that of the bead and the skirt, a considerable constrictive force is placed upon the shoulder surface 19. Interaction between sloping surfaces 19 and 50 is such as to apply a downward force to the closure thereby seating splayed surface 46*a* more firmly against the radiused inner edge 17 of the container with a compressive loading. The pressure applied is considerable as it is applied to an annular line of contact between these two surfaces and is sufficient to overcome minute irregularities in their formation and ensure continuous, fluid-tight contact which would not obtain with plane surface-to-surface contact.

Removal of the closure is quite simple, being merely a matter of applying leverage under the skirt 51 and against the upper surface of flange 20 on the container with a screw driver or like tool. Working progressively around the container will release the closure fully and allow its complete removal with ease.

Because the skirt tends towards an axially straight line relationship with the remainder of wall 48, there is a tendency for the outer wall to flex about a point towards the base thus assisting in removal of the bead from around the shoulder. Although the skirt is no thicker than the wall above the bead, there is little or no tendency for the skirt itself to flex relative to the wall above it at least until the bead has been stretched around the shoulder 18.

The container according to the invention and also according to the embodiment described above, provides an efficient seal for fluid-tightly sealing any liquid and in particular paint within the container while the seal may be made by hand pressure. This is largely because of the single point contact along the line of sealing engagement at edge 17 and surface 46*a* which provides a continuous unbroken seal. The seal is found to be more efficient than in constructions having container bodies and closures engagable over two annular areas of contact, which in practice result in varied pressure being applied first to one and then the other area of contact because of difficulties in manufacture and fitting. In the latter case, leak paths can be caused. The seal is also a better seal than one in which there is a large area of contact when surfaces are engaged over a substantial distance in axial cross-section as such surfaces would require to be very carefully prepared to enable them to provide complete sealing contact.

Further, because of the flared skirt extending at an angle of 40° to the vertical and there is little or no tendency for it to flex relative to the remainder of the wall above it, there is no reason for the provision of a much thicker section of plastics material for the skirt which could cause shrinkage distortion problems after moulding.

It should be understood that minor changes in configuration and materials may be made without departing from the spirit of the invention and the scope of the appended claims. In particular, the materials mentioned above for the container body and closure may be replaced by other materials which have suitable characteristics for the purpose of the application such as, for example, suitability of modulus of stiffness.

What is claimed is:

1. A container comprising a container body and a closure both being of plastics material, the body having an annular wall defining an opening and a lip around the opening, the lip having a sealing region surrounding the opening and a radially outwardly directed shoulder spaced axially along the wall from the sealing region, the shoulder having an abutment surface facing radially outwardly and axially away from the lip, and the closure having a cover portion surrounded by a U-shaped rim, the rim comprising a radially inner axial wall, a spaced radially outer axial wall and a base interconnecting said walls which define between them an axially facing recess of the rim for insertion of the lip between the walls, the rim also including a sealing region at the junction of the inner wall and base, one sealing region being in compressively loaded and tangential engagement with the other region to provide substantially a point contact between the regions in a cross-section along the axis and along a single annular line when the lip is received within the rim, and the outer wall incorporating a radially inwardly projecting bead to coact with the shoulder to urge the lip towards the base of the rim and to urge the sealing regions into said engagement, the outer wall being resiliently flexible outwardly for snap engagement around and release from the shoulder.

2. A container according to claim 1 in which the rim sealing region is an annular splayed surface at the junction of the inner wall and base and the lip sealing region is a convex edge of said lip.

* * * * *